US010519921B2

(12) United States Patent
Schieber et al.

(10) Patent No.: US 10,519,921 B2
(45) Date of Patent: Dec. 31, 2019

(54) IGNITION DEVICE FOR A TWO-STROKE ENGINE

(71) Applicant: Andreas Stihl AG & Co. KG, Waiblingen (DE)

(72) Inventors: Eberhard Schieber, Backnang (DE); Georg Maier, Kernen (DE); Franz Mandl, Fellbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 152 days.

(21) Appl. No.: 15/171,769

(22) Filed: Jun. 2, 2016

(65) Prior Publication Data

US 2016/0273507 A1 Sep. 22, 2016

Related U.S. Application Data

(63) Continuation of application No. 13/667,867, filed on Nov. 2, 2012.

(30) Foreign Application Priority Data

Nov. 4, 2011 (DE) ..... 10 2011 117 600

(51) Int. Cl.

| | |
|---|---|
| ***F02P 1/02*** | (2006.01) |
| ***F02P 1/08*** | (2006.01) |
| ***F02P 1/00*** | (2006.01) |
| ***F02P 3/08*** | (2006.01) |

(52) U.S. Cl.

CPC ..... *F02P 1/02* (2013.01); *F02P 1/00* (2013.01); *F02P 1/086* (2013.01); *F02P 3/0838* (2013.01)

(58) Field of Classification Search

CPC .... F02P 1/02; F02P 3/0838; F02P 1/00; F02P 1/086

See application file for complete search history.

(56) References Cited

U.S. PATENT DOCUMENTS

| | | | | |
|---|---|---|---|---|
| 4,033,316 A | | 7/1977 | Birchenough | |
| 4,549,114 A | * | 10/1985 | Herden | F02P 3/0823 123/144 |
| 4,613,789 A | * | 9/1986 | Herden | F02P 3/0823 313/123 |

(Continued)

FOREIGN PATENT DOCUMENTS

| | | | | |
|---|---|---|---|---|
| CN | 1135019 A | | 11/1996 | |
| DE | 22 21 389 A1 | | 11/1973 | |
| DE | 3338271 A1 | * | 4/1984 | G01L 23/221 |

*Primary Examiner* — David Hamaoui

(74) *Attorney, Agent, or Firm* — Walter Ottesen, P.A.

(57) ABSTRACT

The invention relates to an ignition device for triggering an ignition spark at a spark plug by way of an ignition generator. The latter includes a magnet wheel, which has two permanent magnets arranged at a spacing from each other in the peripheral direction and a magnetic yoke. The magnetic yoke carries a charging coil which charges an ignition capacitor, a primary coil and a secondary coil connected to the spark plug. During every passing of a permanent magnet, a voltage is induced in the coils, wherein, in order to trigger the ignition spark, the ignition capacitor is discharged via a switch element. In order to avoid an unwanted ignition at the bottom dead center of the piston, a device for reducing the voltage that occurs at the spark plug is provided.

1 Claim, 2 Drawing Sheets

(56) References Cited

U.S. PATENT DOCUMENTS

| | | | | | |
|---|---|---|---|---|---|
| 4,658,185 | A * | 4/1987 | Albrecht | H01T 13/54 | 313/123 |
| 4,658,773 | A * | 4/1987 | Treudler | F02P 7/10 | 123/146.5 A |
| 4,983,882 | A * | 1/1991 | Mayring | F02P 9/002 | 123/169 R |
| 5,070,839 | A | 12/1991 | Okuda | | |
| 5,638,799 | A | 6/1997 | Kiess et al. | | |
| 7,363,910 | B2 * | 4/2008 | Schieber | F02P 3/0807 | 123/406.24 |
| 7,594,958 | B2 * | 9/2009 | Krichtafovitch | B03C 3/68 | 315/506 |

* cited by examiner

IGNITION DEVICE FOR A TWO-STROKE ENGINE

CROSS REFERENCE TO RELATED APPLICATIONS

This is a continuation application of U.S. patent application Ser. No. 13/667,867, filed Nov. 2, 2012, and claims priority of German patent application no. 10 2011 117 600.8, filed Nov. 4, 2011, and the entire contents of both are incorporated herein by reference.

FIELD OF THE INVENTION

The invention relates to an ignition device for triggering an ignition spark at a spark plug of a combustion engine, in particular for a two stroke engine in a handheld work apparatus.

BACKGROUND OF THE INVENTION

U.S. Pat. No. 7,363,910 discloses an ignition device which includes a magnet wheel which rotates with the crankshaft and a stationary yoke having coils which is assigned to the magnet wheel. The magnet wheel carries two permanent magnets which are located diametrically opposite each other and which close the magnetic circuit of the yoke twice over the course of one rotation. A charging coil for charging the ignition capacitor is wound around one arm of the U-shaped yoke, while the ignition coil made up of a primary coil and a secondary coil is wound around the other arm. The arrangement of two magnets enables a strong, long-burning ignition spark which ensures reliable ignition of the mixture as well as a sufficient supply of energy for control units, actuators or sensors.

In unfavorable operating states, no ignition occurs over multiple revolutions of the combustion engine (for example, because of ignition suppression in order to limit the maximum rotational speed), so that, because of the scavenging principal of two stroke engines, the combustion chamber is also filled with mixture at the bottom dead center of the piston. In the case of atmospheric pressure in the combustion chamber, much lower voltages at the spark plug are sufficient to trigger an ignition spark than in the case of a mixture that is compressed, that is to say under positive pressure, in the combustion chamber. On account of the construction type of the magnet wheel and the ignition device, a voltage is induced in the coils by the two permanent magnets in the region of the bottom dead center, the induced voltage leading to a high voltage of 2 kV to 3 kV in the secondary coil. This can lead to an ignition spark at the spark plug at the atmospheric pressure that prevails in the combustion chamber in the region of the bottom dead center. If the combustion chamber is filled with combustible mixture because of an absence of combustion, this can lead to ignition of the mixture in the region of the bottom dead center of the piston. This leads to uncontrolled combustion and thus to irregular running of the engine.

SUMMARY OF THE INVENTION

It is an object of the invention to develop an ignition device of the generic type in such a manner that ignition of the mixture in the region of the bottom dead center of the piston is reliably prevented.

The ignition device of the invention is for triggering an ignition spark at a spark plug of a combustion engine having a crankshaft driven by a piston configured to move in a reciprocating manner between top dead center and bottom dead center. The ignition device includes: a magnet wheel defining a periphery and being configured to be driven in rotation by the crankshaft of the combustion engine, the magnet wheel having a first permanent magnet and a second permanent magnet arranged on the magnet wheel at a distance from each other; an ignition capacitor; a yoke assembly including a magnetic yoke fixedly mounted at the periphery, a charging coil, a primary coil and a secondary coil; the charging coil being configured to charge the ignition capacitor; the secondary coil being connected to the spark plug; the magnet wheel having a first rotational angle region around the top dead center of the piston and a second rotational angle region around the bottom dead center of the piston; the magnet wheel being configured to magnetically close the yoke via the first permanent magnet in the first rotational angle region and to magnetically close the yoke via the second permanent magnet in the second rotational angle region; the charging coil, the primary coil and the secondary coil each being configured to have a first voltage induced therein when the yoke is magnetically closed by the first permanent magnet and a second voltage induced therein and present at the spark plug when the yoke is magnetically closed by the second permanent magnet; a switch element; an ignition control unit for driving the switch element so as to cause the ignition capacitor to discharge to trigger the ignition spark in the first rotation angle region; and, a voltage reduction unit configured to be active in the second angle region of the magnet wheel to reduce the second voltage so as to effect a reduced voltage at the spark plug.

The device for reducing the voltage applied to the spark plug is active at least in the second rotational angle region, within which there is approximately atmospheric pressure in the combustion chamber and, because of the type of construction, a low high voltage of, for example, 2 kV to 3 kV can lead to an ignition spark at the spark plug. Expediently, the device is inactive in the remaining first rotational angle region so that the ignition device operates reliably in a known manner. The top dead center of the piston is in the first rotational angle region; the bottom dead center is in the second rotational angle region.

The device for reducing the voltage applied to the spark plug is preferably a switch element which is controlled by a control unit in dependence on the rotational angle of the magnet wheel. The control unit can be formed by the ignition control unit.

In a preferred embodiment, the switch element is arranged parallel to the primary coil, that is to say the primary coil is short-circuited via the switch element with or without a load. As a result, a suppression of the voltage induced at the bottom dead center results, with the effect that the high voltage that builds up in the secondary coil is less by factors, and so an ignition spark at the spark plug can be ruled out even at atmospheric pressure in the combustion chamber.

It may be advantageous to arrange the switch element in series with the spark plug and thus to interrupt the voltage branch of the spark plug in a predetermined second rotational angle region. If the switch element is parallel to the spark plug, the secondary coil is short-circuited, and this leads to corresponding attenuation.

The switch elements for reducing the voltage applied to the spark plug are advantageously electronic switch elements such as thyristors, MOSFETs or other transistors.

In an alternative embodiment, it may be sufficient to provide as the device a pre-sparking gap arranged between the secondary coil and the spark plug, the pre-sparking gap blocking voltages of, for example, less than 3 kV. Only at voltages over 3 kV does the pre-sparking gap become conductive, and so only high voltages of more than 3 kV can be applied to the spark plug.

In the same manner, the device can be a blocking diode arranged between the secondary coil and the spark plug, the blocking diode blocking undesired induced high voltages of, for example, 3 kV in the blocking direction.

The pre-sparking gap and the blocking diode operate without active activation by a control unit in dependence on the high voltage generated in the secondary coil. Voltages above 3 kV are allowed to pass to the spark plug while smaller high voltages are blocked.

A reduced voltage in the secondary coil can also be achieved in that the magnetic flux occurring in the yoke is weakened within the second rotational angle region. In this case, the device for reducing the voltage applied to the spark plug can be configured as a larger air gap between the two permanent magnets and the yoke.

A weakening of the magnetic flux is also possible as a result of weaker magnetization of the second permanent magnet, wherein to compensate for the reduced energy generation two permanent magnets can be provided over the circumference of the magnet wheel.

The device can also be formed by one permanent magnet having an altered geometry; if the poles of the permanent magnet are at a greater distance from each other than the opening of the yoke to be closed, then only a small magnetic flux can form. This leads to a corresponding reduction in the voltage induced in the secondary coil and thus at the spark plug.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
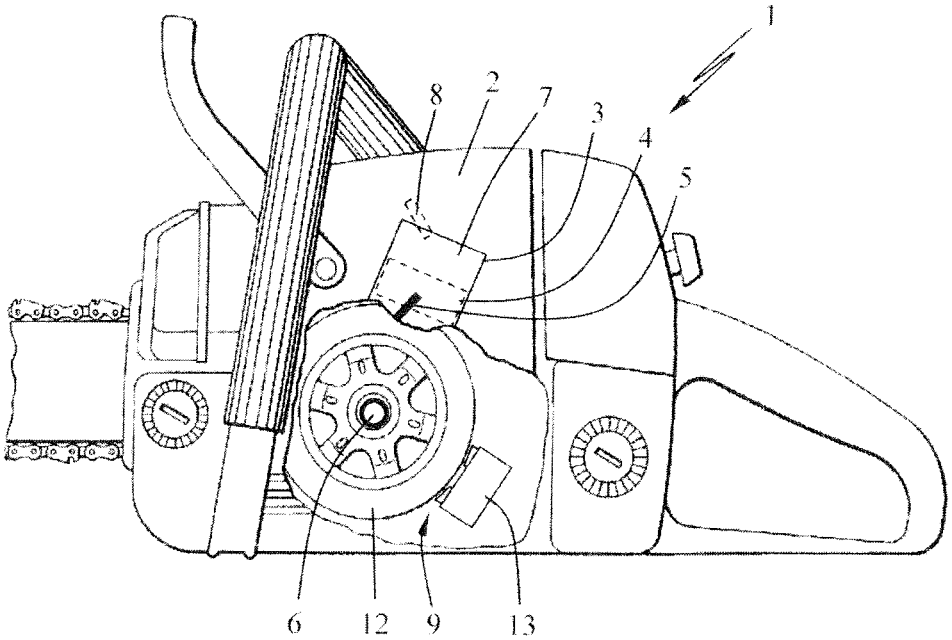
FIG. 1 is a schematic view of a work apparatus using the example of a chain saw.

The work apparatus illustrated in FIG. 1 is a portable, handheld work apparatus 1 having a combustion engine arranged in a housing 2. The combustion engine is, in particular, a two-stroke engine, preferably a one cylinder two-stroke engine having a cylinder 3 in which a piston 4 is arranged. The piston 4, which reciprocates between a top dead center TDC and a bottom dead center BDC, drives a crankshaft 6 via a connecting rod 5. The piston 4 delimits a combustion chamber 7 into which mixture is conveyed in accordance with the two-stroke method which is known per se. A spark plug 8, which releases a controlled ignition spark in the region of the top dead center of the piston 4 in order to ignite the compressed mixture in the combustion chamber 7, projects into the combustion chamber. At the bottom dead center of the piston, the combustion chamber 7 is connected to the atmosphere via an outlet so that the exhaust gases from a previous combustion can flow out.

The spark plug 8 is controlled by an ignition device 10 which triggers an ignition spark 11 at the spark plug 8 (FIG. 3) in dependence on the rotational speed and the load of the combustion engine. For this purpose, an ignition control unit 33 is provided.

The energy for the ignition is generated by an ignition generator 9 which consists of a magnet wheel 12 and a yoke 13 which is assigned in a stationary manner to the magnet wheel; coils 16, 17 and 18 are arranged on the arms 14 and 15 of the yoke 13. The coils 16 to 18 can be cast together with the yoke 13 to form a structural unit 19 having a small installation space. Weight is also reduced as a result of this compact construction type.

Figure 2:
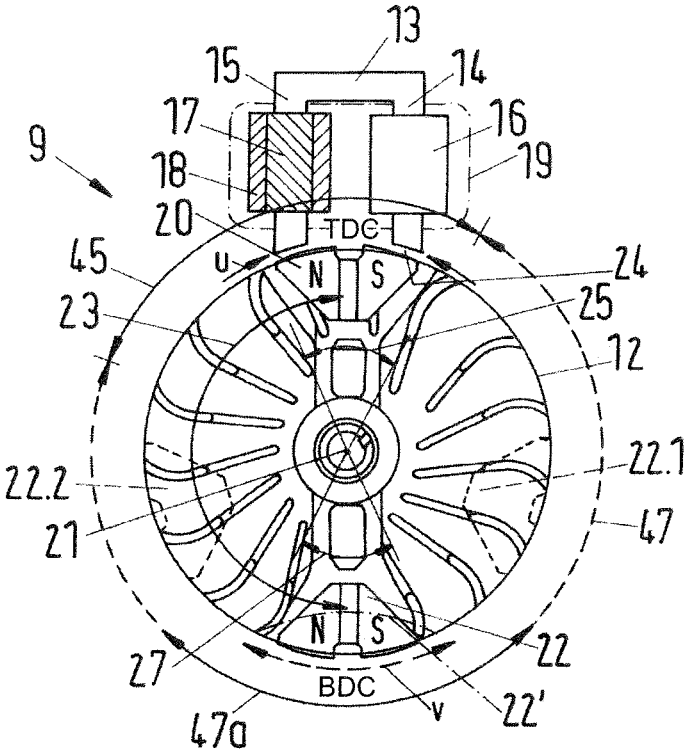
FIG. 2 shows the arrangement of the rotating magnet wheel and the stationary yoke in an enlarged view.

The magnet wheel 12, which is advantageously the fan wheel of the air cooled two-stroke engine in the exemplary embodiment, carries, for example, two permanent magnets 20 and 22. In the exemplary embodiment shown, the permanent magnets 20 and 22 are arranged diametrically opposite each other in relation to the rotational axis 21 of the magnet wheel 12, wherein the magnets 20 and 22 are oppositely magnetized. In the exemplary embodiment shown, the permanent magnets 20 and 22 thus lie at a spacing 23 of 180° crankshaft angle from each other in the circumferential direction of the magnet wheel 12. Other distances between the permanent magnets can be advantageous. It can also be practical to provide more than two permanent magnets (20, 22.1, 22.2) (FIG. 2) over the circumference of the magnet wheel 12, for example three or more magnets.

The magnet wheel 12 in the exemplary embodiment shown is rotationally driven by the rotating crankshaft 6 of the combustion engine; the magnet wheel 12 is preferably flanged on the end of the crankshaft 6 and rotates therewith. The spacing 23 of the permanent magnets 20 and 22 therefore corresponds to a crankshaft angle of 180°, wherein the permanent magnet 20 magnetically closes the yoke 13 at the top dead center TDC of the piston 4 and the permanent magnet 22 magnetically closes the yoke 13 at the bottom dead center BDC.

The yoke 13, preferably the one arm 14 of the yoke 13, carries the charging coil 16 which serves to charge an ignition capacitor 30. The primary coil 17 and the secondary coil 18 of the ignition coil 31 are also arranged on the yoke 13, preferably on the other arm 15 of the yoke 13, wherein the secondary coil 18 lies on the primary coil 17, which for its part is wound on the arm 15.

The yoke 13 is magnetically closed via the permanent magnets 20 and 22 so that a magnetic flux is generated in the yoke 13 via the permanent magnets. This flow is greatest when the permanent magnet magnetically closes the free ends of the yoke 13; this corresponds to a maximum induction voltage. When the yoke 13 opens, the induction voltage breaks down again.

While the permanent magnet 20 leads to a positive voltage pulse 26 in the secondary coil 18, a negative voltage pulse 28 of the same magnitude is generated (FIG. 4) when the permanent magnet 22, which is magnetized with opposing poles, passes the yoke 13, as long as a permanent magnet of the same strength is used.

Figure 3:
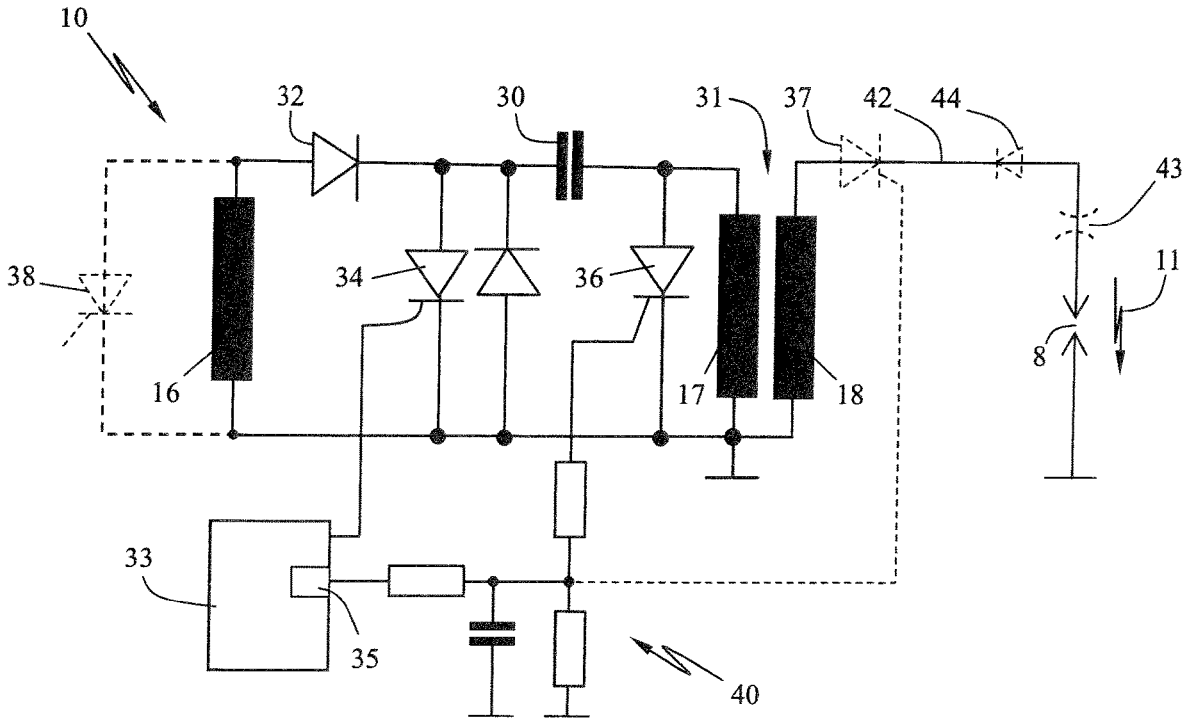
FIG. 3 shows a schematic circuit diagram of the ignition device.
Figure 4:
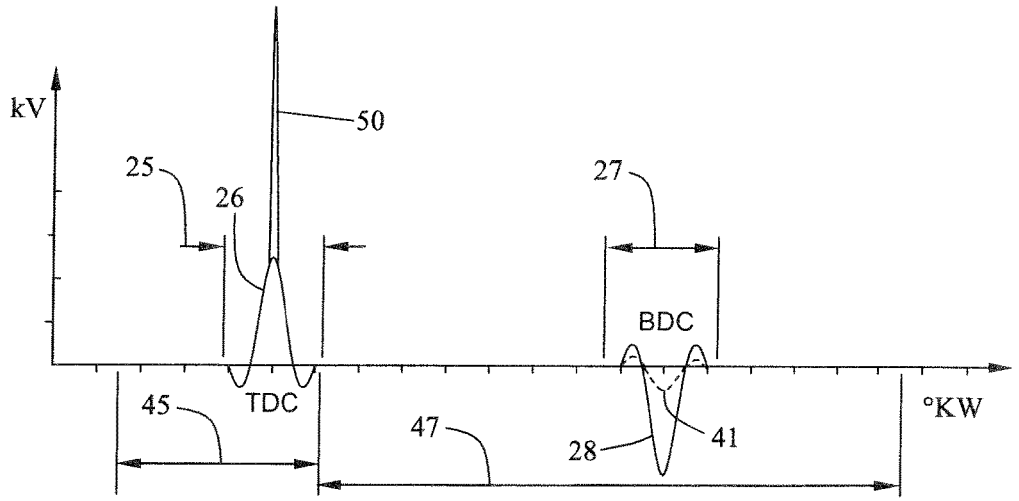
FIG. 4 shows a graph of the voltages induced in the secondary coil over the course of one magnet wheel rotation.

As the circuit diagram of the ignition device 10 according to FIG. 3 shows, the ignition capacitor 30 is charged via the diode 32 and the primary coil 17. The voltage that results on the secondary side because of the induced voltage in the ignition coil 31 is shown in FIG. 4. The voltage resulting from the induction on the secondary coil 18 of the ignition coil 31 is in the range of approximately 2 kV to 3 kV, which is also applied to the electrodes of the spark plug 8. The maximum voltage pulse 26 or 28 is preceded by a small voltage wave which occurs when the permanent magnet nears the yoke 13. If the yoke 13 has been magnetically closed via the permanent magnet, the illustrated maximum voltage pulse 26 or 28 (FIG. 4) results; when the permanent magnet is removed from the yoke again, a decaying voltage wave occurs. The voltage pulse 26 or 28 is thus always surrounded by a leading and a trailing voltage wave.

In the region of the top dead center TDC (FIG. 4), the mixture in the combustion chamber is highly compressed, and so the voltage of 2 kV to 3 kV resulting from the induction on the secondary side of the ignition coil 31 is not sufficient to create an ignition spark 11. For this reason, at the desired ignition time, the ignition control unit 33 connects through a switch element 34, in the exemplary embodiment shown, a thyristor, which closes a circuit formed by the ignition capacitor 30 and the primary coil 17; the ignition capacitor 30 can discharge via the primary coil 17. The discharge leads to an ignition voltage 50 of over 20 kV on the secondary side of the ignition coil, which is sufficient to trigger an ignition spark 11 and reliable ignition of the compressed mixture in the combustion chamber 7. In this case, the ignition occurs approximately at TDC, and thus is applied as a voltage peak onto the high voltage pulse of approximately 2 kV to 3 kV which is triggered by the induction of the permanent magnet 20.

The ignition control unit 33 is provided with a control unit 35 which serves to control further switch elements 36, 37 and/or 38. Advantageously, the control unit 35 is integrated into the ignition control unit 33 so that only one control unit has to be provided.

The control unit 35 controls the device 40 for reducing the voltage applied to the spark plug 8 in predetermined rotational angle regions. The device 40 is always switched into the active state when the magnet group, that is to say for example the permanent magnet 22, that follows an ignition pulse passes the yoke 13. In the exemplary embodiment shown—because of the diametric arrangement of the permanent magnets 20 and 22 relative to the rotational axis 21 of the magnet wheel 12—the induced voltage is greatest at the bottom dead center (BDC). The induced voltages leads—as with the first permanent magnet 20—to a voltage peak of approximately 2 kV to 3 kV in the secondary coil 18 of the ignition coil 31. Because the combustion chamber 7 is open to the atmosphere at the bottom dead center BDC—the outlet is open to expel the exhaust gases from the combustion chamber—essentially atmospheric pressure prevails in the combustion chamber 7. Under these pressure conditions, a voltage of 2 kV to 3 kV applied to the spark plug 8 can lead to an ignition spark 11. This has no consequences when no combustible mixture is present in the combustion chamber 7. If the two-stroke engine runs for example at a high rotational speed and one or more ignitions are suppressed for the control of the rotational speed, then multiple cycles without a combustion result, which is why combustible mixture at atmospheric pressure can be present in the combustion chamber 7 even when the outlet is open. However, under these conditions, an ignition spark resulting in the rotational angle region around BDC can lead to an ignition, which is undesired. For this reason, according to the invention it is provided that the control unit 35 for reducing the voltage applied to the spark plug 8 connects through a switch element 36 in the form of a thyristor which short-circuits the primary coil 17. As a result, the primary coil is damped so that the secondary voltage 28 still resulting on the secondary side is significantly reduced, as is shown with the dotted line 41 in FIG. 4. The control unit 35 actuates the switch element 36 at least whenever the second permanent magnet 22 passes the yoke 13. As a result, no ignition spark can be formed at the spark plug 8 even under unfavorable conditions at BDC.

A device 40 for reducing the voltage applied to the spark plug 8 is also formed in that a switch element 37 is arranged in the voltage branch 42 of the spark plug 8 and opens the voltage branch 42. Whenever the permanent magnet 22 passes the yoke 13 in the region of the bottom dead center BDC, the voltage branch 42 is opened so that the spark plug 8 is voltage free. The switch element 37 which is configured as a thyristor is only closed again when the mixture in the combustion chamber 7 is being compressed, because with increasing density of the mixture, the voltage required for an ignition spark 11 at the spark plug 8 increases.

In a further embodiment of the device 40, a pre-sparking gap 43, which, for example, blocks voltages of up to 3 kV, can be formed in the voltage branch 42, advantageously between the secondary coil 18 and the spark plug 8. Only when the voltage is greater than 3 kV can the pre-sparking gap 43 be bridged and thus the high voltage be applied to the spark plug 8.

In the same manner, a high voltage diode 44, which is used in the blocking direction in the voltage branch 42, can be provided as the device 40. The high voltage diode 44 acts in the blocking direction in a similar manner to the pre-sparking gap 43; only when the breakdown voltage of for example 2 kV to 3 kV is overcome can a high voltage be applied to the spark plug 8.

Damping of the coils at the bottom dead center of the piston 4 can also be achieved by a device 40, by way of which the charging coil is loaded, preferably short circuited, via a switch element 38, a thyristor in the exemplary embodiment. A reduction in the voltage occurring in the secondary coil 18 at BDC is also achieved as a result of this.

In principle, it is sufficient for the device 40 to be inactive in the first rotational angle region 25 in which the TDC of the piston 4 is located, and to be switched into the active state in the second rotational angle region 27 in which the BDC of the piston 4 is located. In an advantageous development, it is provided that the device 40 is switched into the inactive state within a first expanded rotational angle region 45, wherein the first rotational angle range lies within the first expanded rotational angle range 45; the first expanded rotational angle region includes approximately 90° crankshaft angle and extends, in particular, from approximately 70° crankshaft angle before TDC to approximately 20° crankshaft angle after TDC.

In a corresponding manner, it is advantageous to provide a second expanded rotational angle region 47, which includes the second rotational angle region 27. The second expanded rotational angle region 47 can extend over a region of approximately 90° crankshaft angle. Advantageously the second expanded rotational angle region 47 forms approximately the supplementary angle to the first expanded rotational angle region 45 and thus extends over a region of approximately 20° crankshaft angle after TDC to approximately 70° crankshaft angle before TDC. The second expanded rotational angle region 47 is thus larger than the first expanded rotational angle region 45, preferably approximately by a factor of 3.

Correspondingly, the control unit 35 is configured in such a manner that the device 40 for reducing the voltage is switched into the inactive state in a first expanded rotational angle region 45 from approximately 70° before TDC to 20° after TDC and the device 40 for reducing the voltage is active in the rest of the expanded rotational angle region from 20° after TDC to 70° before TDC. The first expanded rotational angle region 45 thus extends over approximately 90° crankshaft angle, while the second expanded rotational angle region 47 extends over approximately 270° crankshaft angle.

In order to reduce the voltage present in the secondary coil in the second rotational angle region, the device can also be configured so that the magnetic flux occurring in the yoke 13 is weakened. This is possible, for example, in a simple manner because the air gap 24 between the free ends of the yoke arms 14 and 15 and the permanent magnet 22 is configured to be larger than the air gap between the free arms of the yoke 13 and the first permanent magnet 20.

A weakening of the magnetic flux in the yoke 13 can also be achieved in that the second permanent magnet is magnetized more weakly than the first permanent magnet 20. In order to compensate for the reduced energy generation resulting from the weaker magnetization, it can be expedient to provide multiple second, more weakly magnetized permanent magnets 22.1 and 22.2 around the circumference of the magnet wheel 12.

The device for reducing the voltage applied to the spark plug in the second rotational angle region can also be formed in that the geometry of the second permanent magnet 22' is different compared with the geometry of the first permanent magnet 20. In the exemplary embodiment shown, the second permanent magnet 22' extends over a circumferential angle v which is greater than the circumferential angle u of the open ends of the yoke 13 measured in the circumferential direction of the magnet wheel 12. Because of the greater extent of the permanent magnet 22', the yoke 13 cannot be optimally closed, and so the maximum of the magnetic flux is less than in the case of the first permanent magnet 20, which closes the magnetic yoke 13 with a precise fit via its magnetic poles.

If a higher energy yield is required, multiple permanent magnets (20, 22.1, 22.2) can also be arranged around the circumference of the magnet wheel 12, wherein the device 40 for reducing the voltage at the spark plug is then always active in the second rotational angle region.

It is understood that the foregoing description is that of the preferred embodiments of the invention and that various changes and modifications may be made thereto without departing from the spirit and scope of the invention as defined in the appended claims.

What is claimed is:

1. An ignition device for triggering an ignition spark at a spark plug of a two-stroke combustion engine having a crankshaft driven by a piston configured to move in a reciprocating manner between top dead center (TDC) and bottom dead center (BDC), said ignition device comprising:

a magnet wheel defining a periphery and being configured to be driven in rotation by the crankshaft of the combustion engine, said magnet wheel having a first permanent magnet and a second permanent magnet arranged on said magnet wheel at a distance from each other;

an ignition capacitor;

a yoke assembly including a magnetic yoke fixedly mounted at said periphery, and a charging coil, a primary coil and a secondary coil mounted on said magnetic yoke;

said charging coil being configured to charge said ignition capacitor;

said secondary coil being connected to the spark plug;

said magnet wheel having a first rotational angle region around the top dead center (TDC) of the piston and a second rotational angle region around the bottom dead center (BDC) of the piston;

said magnet wheel being configured to magnetically close said magnetic yoke via said first permanent magnet in said first rotational angle region and to magnetically close said magnetic yoke via said second permanent magnet in said second rotational angle region;

said charging coil, said primary coil and said secondary coil each being configured to have a first voltage induced therein when said magnetic yoke is magnetically closed by said first permanent magnet, and said charging coil, said primary coil and said secondary coil each being configured to have a second voltage induced therein when said magnetic yoke is magnetically closed by said second permanent magnet;

and said first and second induced voltages being present at said spark plug when said magnetic yoke is magnetically closed by said first permanent magnet and by said second permanent magnet;

an ignition switch element;

an ignition control unit for driving said ignition switch element so as to cause said ignition capacitor to discharge via said primary coil to trigger said ignition spark in said first rotational angle region; and, a voltage reduction unit configured to be a pre-spark gap arranged between said secondary coil and said spark plug and configured to block or reduce voltages up to predetermined value and to allow voltages above said predetermined value to pass and be applied to said spark plug;

said predetermined value being set to prevent an unwanted ignition at bottom dead center (BDC) and allow ignition at top dead center (TDC).

* * * * *